US009057495B2

(12) United States Patent
Ota

(10) Patent No.: US 9,057,495 B2
(45) Date of Patent: Jun. 16, 2015

(54) ILLUMINATING LAMP AND VEHICLE HEAD LAMP, USING LIGHT EMITTING DIODE

(71) Applicant: Tatsuya Ota, Amagasaki (JP)

(72) Inventor: Tatsuya Ota, Amagasaki (JP)

(73) Assignee: NIHON COATING CO., LTD., Amagasaki-shi (JP)

( * ) Notice: Subject to any disclaimer, the term of this patent is extended or adjusted under 35 U.S.C. 154(b) by 22 days.

(21) Appl. No.: 14/049,834

(22) Filed: Oct. 9, 2013

(65) Prior Publication Data

US 2014/0313757 A1 Oct. 23, 2014

(30) Foreign Application Priority Data

Apr. 17, 2013 (JP) ..... 2013-086690

(51) Int. Cl.
*F21V 7/04* (2006.01)
*F21S 8/10* (2006.01)
*F21Y 101/02* (2006.01)

(52) U.S. Cl.
CPC ..... *F21S 48/115* (2013.01); *F21S 48/1109* (2013.01); *F21S 48/1159* (2013.01); *F21S 48/325* (2013.01); *F21S 48/328* (2013.01); *F21Y 2101/02* (2013.01); *F21V 29/74* (2015.01)

(58) Field of Classification Search
CPC . F21S 48/1104; F21S 48/1109; F21S 48/115; F21S 48/1159; F21S 48/325; F21S 48/328; F21V 29/20; F21V 29/40; F21V 29/50; F21V 29/502; F21V 29/503; F21V 29/60; F21V 29/74
USPC ..... 362/507, 545–549
See application file for complete search history.

(56) References Cited

FOREIGN PATENT DOCUMENTS

| | | |
|---|---|---|
| JP | 2004-214144 | 7/2004 |
| JP | 2006-100836 | 4/2006 |
| JP | 2008-524862 | 7/2008 |

*Primary Examiner* — Jason Moon Han
(74) *Attorney, Agent, or Firm* — Flynn, Thiel, Boutell & Tanis, P.C.

(57) ABSTRACT

An illuminating lamp and a vehicle head lamp, using a light emitting diode, respectively, are capable of not only keeping the same brightness as obtained at the time of lighting after many hours from the lighting, but also being usable for many hours without deterioration in efficiency besides advantages of providing a high output in low power consumption, a long service life, and a simple structure. The illuminating lamp comprises a light source support made up of an upper structure and a lower structure, the upper structure being linked with the lower structure via the heat conduction bar, wherein the light source support is inserted into an aluminum heat-release mount, thereby causing heat generated from the light emitting diode to be released into the aluminum heat-release mount through cooling of the heat conduction bar.

9 Claims, 8 Drawing Sheets

ILLUMINATING LAMP AND VEHICLE HEAD LAMP, USING LIGHT EMITTING DIODE

BACKGROUND

The present invention relates to an illuminating lamp and a vehicle head lamp, using a light emitting diode, respectively, and in particular, to an automobile head lamp using a light emitting diode.

Because a light emitting diode (an LED) has many advantages such as high emission of light at low power consumption, a long service life, a simple structure, compactness of a device thereof, and so forth, an application rage of the LED has lately increased in a short while. However, considerable deterioration in efficiency at high temperature is cited as a weakness of the LED.

TECHNICAL FIELD

In Patent document 1, in order to provide an LED device that can be effectively cooled, in particular, as a problem to be solved, there is described an LED device provided with at least one optical element disposed at each LED chip so as to correspond thereto, at least one thermal conduction element suited to lead out heat generated by the LED chip, and at least one cooling device suited to lead out the heat delivered by the thermal conduction element.

In Patent document 2, in order to provide an automobile headlamp having a long service life and low power consumption, for checking safety in a traveling direction, installed in the front part of an automobile, as a problem to be solved, there is described a structure comprising a headlamp provided with a projection convex lens, and a light-emission face made up of a plurality of LED chips disposed behind a backward focal point F of the projection convex lens, a constant current drive circuit for executing on-off control of each LED chip, a control circuit (not shown) for lighting up the LED chips for each group while delaying an energization timing phase, thereby leading out light having a constant emission amount emanated from the LED chips.

In Patent Document 3, it is described that the invention is concerned with a lighting equipment provided with at least one LED and a cooling body for cooling the at least one LED, the cooling body is provided with an engagement means, and at least one unit of the lighting equipment serving as a light source is disposed in an automobile head lamp such that the engagement means can be useful in forming a bayonet joint with a holder for the lighting equipment. However, in any of these Patent Documents, no mention has been made of an automobile head lamp provided with an LED whose luminous flux at 1,300 lm or more.

CITATION LIST

Patent Literature

Patent Document 1: JP 2006-100836 A
Patent Document 2: JP 2004-214144 A
Patent Document 3: JP 2008-524862 A

SUMMARY OF THE INVENTION

If use is made of a vehicle head lamp using an LED, with a luminous flux at 1,000 lm, no particular problem has arisen in the past. However, if the vehicle head lamp is continuously used at 1,200 lm or more, and the temperature thereof keeps rising, the LED will undergo a significant deterioration in efficiency to thereby cause a rapid drop in luminance down to 1,000 lm or less. This seems elicitation of a weakness of the LED against temperature.

The inventor has succeeded in finding out a structure of an illuminating lamp capable of efficiently releasing heat generated at an LED in order to solve the problem described.

More specifically, the invention provides in its one aspect an illuminating lamp using an LED 1, the illuminating lamp including a light source support 6 made up of an upper structure where an aluminum sheet fixed to a semiconductor substrate 4 with an LED 1 mounted thereon is directly fixed to a region of the surface of a heat conduction bar 6-1 made of copper, other than a region thereof, with the aluminum sheet fixed thereto, is coated with aluminum, up to a mouth piece 7 in such a way as to form light-shielding walls A, B, and a lower structure having a long heat conduction bar 6-1 made of copper, the upper structure being linked with the lower structure via the heat conduction bar 6-1 made of copper, wherein the light source support 6 is inserted into an aluminum heat-release mount 8, a central part thereof being hollow, through a mouth piece 7, via the heat conduction bar 6-1 made of copper, to be secured at a position where the tip of the heat conduction bar 6-1 made of copper reaches a point deep inside the hollow part 8-3 of the aluminum heat-release mount 8, thereby causing heat generated from the LED 1 to be released into the aluminum heat-release mount 8 through cooling of the heat conduction bar 6-1 made of copper by the air inside the hollow part 8-3.

Further, with the illuminating lamp using the LED 1, the aluminum sheet fixed to the semiconductor substrate 4 with the LED 1 mounted thereon may be directly fixed to the heat conduction bar 6-1 made of copper by ultrasonic welding.

Still further, with the illuminating lamp using the LED 1, the long heat conduction bar 6-1 made of copper, as the lower structure of the light source support 6, may be inserted into the aluminum heat-release mount 8, the central part thereof being hollow, through a mouth piece 7, to be secured at the position where the tip of the heat conduction bar 6-1 made of copper reaches the point deep inside the hollow part 8-3 of the aluminum heat-release mount 8, and molten aluminum may be poured into space of the hollow part 8-3, on a side thereof, adjacent to the mouth piece 7, thereby securing a part of the heat conduction bar 6-1, on a side thereof, adjacent to the mouth piece 7.

Yet further, with the illuminating lamp using the LED 1, a radiation groove or a radiation fin 8-1 may be provided on the surface of the aluminum of the upper structure of the light source support 6, and the hollow part 8-3 of the heat-release mount 8, the central part thereof being hollow, may be provided with the radiation fin 8-1 on the outer periphery thereof, the hollow part 8-3 being formed in the shape of a column or a prism.

Further, with the illuminating lamp using the LED 1, the hollow part 8-3 of the heat-release mount 8 may be formed in the shape of the column or the prism, and a radiation fan driven by a waterproof motor may be provided inside the hollow part 8-3.

Still further, with the illuminating lamp using the LED 1, the LED 1 may have a luminous flux at 1,300 lm or more.

Furthermore, the invention provides in its another aspect a vehicle head lamp, using the illuminating lamp using the LED 1, according to any of the embodiments of the invention, whereby a projection lens and the center axis of a light source support 6 are disposed on an optical axis extending in the front to back direction of a vehicle, an LED 1 serving as a light source is fixed to an upper face or a lower face of a light source support 6, in relation to the optical axis, and a reflecting mirror is provided on the optical axis such that light emanated from the light source is substantially projected through the projection lens in the direction of the optical axis.

Further, with the vehicle head lamp, using the illuminating lamp using the LED 1, according to any of the embodiments of the invention, a distance from the center of the light source to a reference face of the mouth piece 7 may be any length selected from the group consisting of 31.25 mm, 24.55 mm, 31.625 mm, 27.375 mm, 27.25 mm, 27.4 mm, 26.85 mm, 27.5 mm, 27.05 mm, 31.5 mm, 18 mm, 31.25 mm, and 27.1 mm.

Effects of the Invention

Because the invention has adopted configurations described as above, the illuminating lamp and the vehicle head lamp, using the light emitting diode, respectively, or the automobile head lamp using the light emitting diode, can be provided. More specifically, it has been possible to realize a compact illuminating lamp, the vehicle head lamp, and the automobile head lamp, in particular, these lamps being capable of not only keeping the same brightness as obtained at the time of lighting after many hours from the lighting, but also being usable for many hours without deterioration in efficiency besides advantages of providing a high output in low power consumption, a long service life, and a simple structure.

DETAILED DESCRIPTION OF THE PREFERRED EMBODIMENTS

Figure 3:
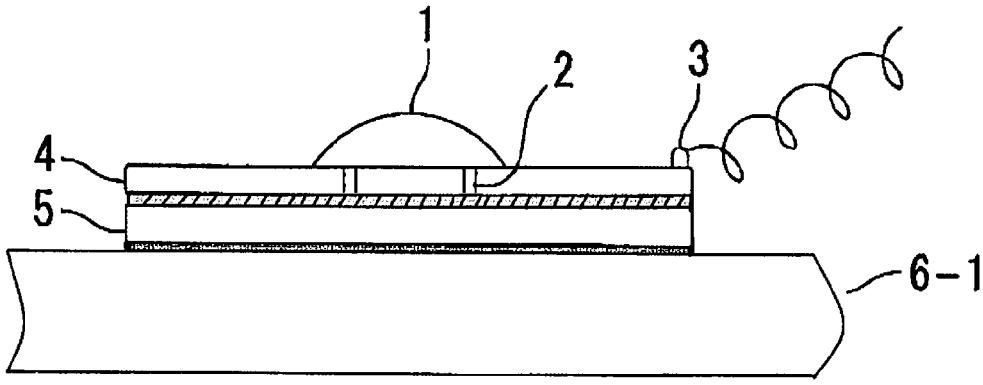
FIG. 3 is a side view showing a fixation part of the light emitting diode (LED) in detail.
Figure 4:
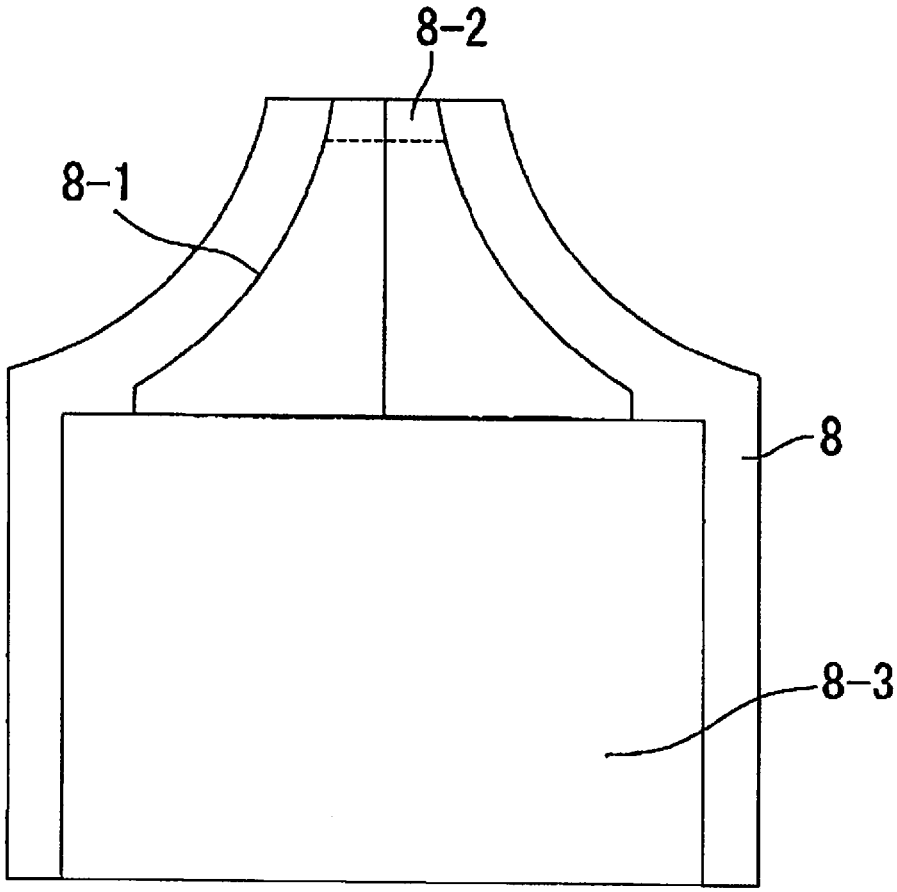
FIG. 4 is a side view of the heat-release mount.
Figure 5:
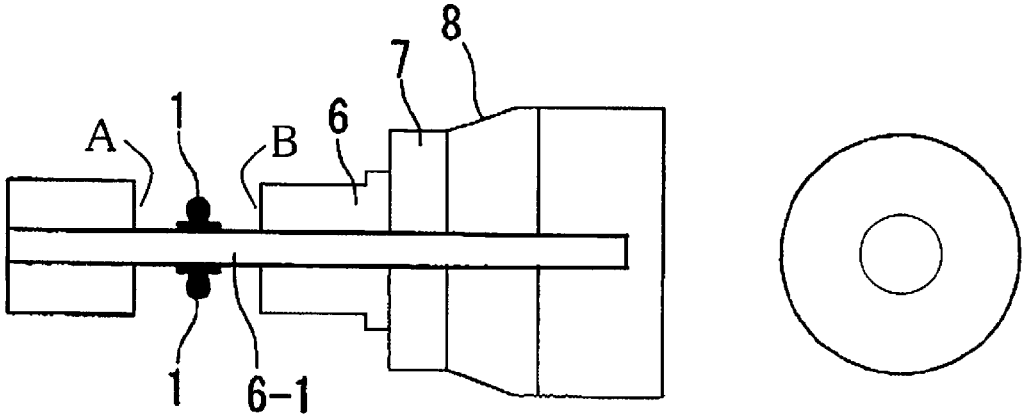
FIG. 5 is a schematic illustration showing an example of the head lamp using the LED, according to the invention.

With the present invention, a light source support 6 is made up of an upper structure where an aluminum sheet 5 of a luminous element unit (hereinafter referred to as the luminous element unit) with a light emitting diode (an LED) 1 mounted on top of a semiconductor substrate 4 mounted on the aluminum sheet 5 is directly fixed to a heat conduction bar 6-1 made of copper, as shown in FIG. 3, a surface of the heat conduction bar (6-1) made of copper, in a non-fixation part thereof, is coated up to a mouth piece 7 in such a way as to form light-shielding walls A, B, as shown in FIG. 5, and a lower structure having a long heat conduction bar (6-1) 6-1 made of copper. By inserting a light source support 6 linked with the heat conduction bar (6-1) made of copper, via the mouth 7, into an aluminum heat-release mount 8, a central portion thereof being hollow as shown in FIG. 4, an illuminating lamp using an LED, having a structure capable of effecting direct thermal conduction of heat generated from the LED to the aluminum heat-release mount 8, is provided.

More specifically, the light source support with the luminous element unit attached thereto is a supporting element structured such that a core thereof is made of copper, and the periphery thereof is coated with aluminum, and there is provided the illuminating lamp using the LED having a structure where an LED unit (the aluminum sheet to which the semiconductor substrate with the LED mounted thereon is fixed) is attached to the surface of copper. As shown in FIG. 3, the LED is fixed to the aluminum sheet 5 through the intermediary of a LED-fixation part 2, and the semiconductor substrate 4 is fixed to the aluminum sheet 5 by use of an adhesive excellent in heat conductivity.

Further, with the present invention, in a method for coating the heat conduction bar (6-1) made of copper with aluminum, molten aluminum is poured into a mold with the heat conduction bar (6-1) made of copper, inserted therein, up to a region of an insertion part of the heat-release mount, except for the heat conduction bar (6-1) made of copper, the heat conduction bar (6-1) made of copper, partially coated with aluminum, is taken out after cooling, a portion of aluminum, joined to the LED unit, is cut away until a copper part is exposed such that the light-shielding walls A, B are formed, and subsequently, the LED unit (the aluminum sheet to which the semiconductor substrate with the LED mounted thereon is fixed) is directly fixed. As for a fixing method, the LED unit may be fixed by use of a heat-conductive adhesive or fixed by screwing after applying a metal paste thereto or fixed by ultrasonic welding. As the adhesive excellent in heat conductivity, SK3ON, SK6ON, SK7ON, SK100N, SK100SDN, SK100SFN, and so forth, produced by Diemat Inc., are cited. For the metal paste, use of a gold paste, silver paste, copper paste, nickel paste, and so forth is well known, however, the silver paste is preferably used from the viewpoint of the heat dispersion properties thereof, and economics. As an example of the silver paste, CT212M, CT284R, CT285 (produced by KYOCERA Chemicals Corporation), TB3300 series (produced by Three Bond Co. Ltd.), and so forth are cited. Among those fixing methods, fixing by the ultrasonic welding is most preferable because the LED unit can be directly fixed without involving an unnecessary matter, and an adhesive application step, a metal-paste application step, and a screwing step can be omitted.

Needless to say, the fixing method by use of the metal paste, or the adhesive, together with the ultrasonic welding, can be made. Further, fixing by the screwing may be carried out after fixing by the ultrasonic welding.

Further, in a method for inserting the light source support 6 into the heat-release mount 8 having the hollow part at the center, fixing may be executed by use of an epoxy-based adhesive excellent in heat conductivity, or molten aluminum may be poured from the back side of the heat-release mount, where the light source support is inserted (from a side of the heat-release mount, opposite from a side thereof, where the light source support is inserted) to thereby execute fixing.

Because fixation resulting from pouring the molten aluminum from the back side of the heat-release mount, where the light source support is inserted (from the side of the heat-release mount, opposite from the side thereof, where the light source support is inserted) is robust, and is also susceptible to heat conduction, this is therefore most preferable.

Light emanated from a light source is reflected by a reflecting mirror to pass through a projection lens, whereupon necessary distribution of light is acquired. The light source is an LED high in both output, and luminance. The LED 1 has luminance normally at not less than 800 lm, and more preferably at not less than 1,000 lm. Electrical power is supplied from an external power-supply connection terminal 3 to the LED 1 via a lead wire 3-1. The LED 1 is fixed to the semiconductor substrate 4 through the intermediary of the LED-fixation part 2, and the respective ends of the LED-fixation part 2 reach a metal thin-sheet 5 (the aluminum sheet 5) to thereby assist heat conduction.

If the LED with luminance at not less than 1,300 lm is used, luminance thereof will decrease with time, dropping to 1,000 lm or less in a short time, in particular. The reason for this is because the LED is low in heat resistance.

If a high-output LED is provided with a cooling fan only, illuminance normally drops rapidly with time upon lighting, and luminance at 1,300 lm drops down to 1,000 lm in about 60 minutes.

With the present invention, a light emitting diode substrate 4 with the light source (the LED) 1 mounted thereon is welded to a metal thin film 5 made of copper, aluminum, and so forth, as shown in FIG. 3, and further, the metal thin film 5 is normally welded to, or brazed to the light source support 6, The light source support according to the invention is a support having a structure where the core of the light source is formed of copper, the periphery thereof is surrounded by aluminum, and for the copper, use is made of pure copper or a copper alloy; for example, a beryllium copper alloy, and so forth are cited.

The light source support according to the present invention is a support having a structure where the core of the light source is formed of copper, the periphery thereof is surrounded by aluminum, and for the aluminum, use is made of pure aluminum or an aluminum alloy; for example, an aluminum alloy No. 6063, and so forth are used.

Thus, the light source support according to the present invention is the support having the structure where the core of the light source support is formed of copper, the periphery thereof is surrounded by aluminum, and the inventor has found out that this structure enables excellent heat conduction to be secured. An aluminum mass is cut away in such a fashion as to form the light-shielding walls A, B to form a flat part by exposing copper, and the aluminum sheet fixed to the semiconductor substrate with the LED mounted thereon is fixed to the flat part by ultrasonic welding, and so orth. Further, in FIGS. 5 and 6, there is shown an example where an angle of the light-shielding wall A, or the light-shielding wall B, formed against the heat conduction bar (6-1), is 90 degrees, however, any angle in a range enabling an object for light-shielding to be achieved can be selected.

Although a power supply line of the LED is not shown, it can be disposed inside the light source support 6, or along the outside thereof. For the power supply line, an electric wire is normally used, but an electrically conductive film or an electrically conductive thin sheet can be used instead.

As radiation fin (8-1)s provided in the light source support 6, fins in various shapes, such as one in a thin sheet-like shape, one protruding from a post, in parallel with the optical axis, one in sheet-like shape protruding at right angles to the optical axis, and one in bar-like shape protruding at right angles to the optical axis, can be recalled, however, any thereof can be used.

Figure 1:
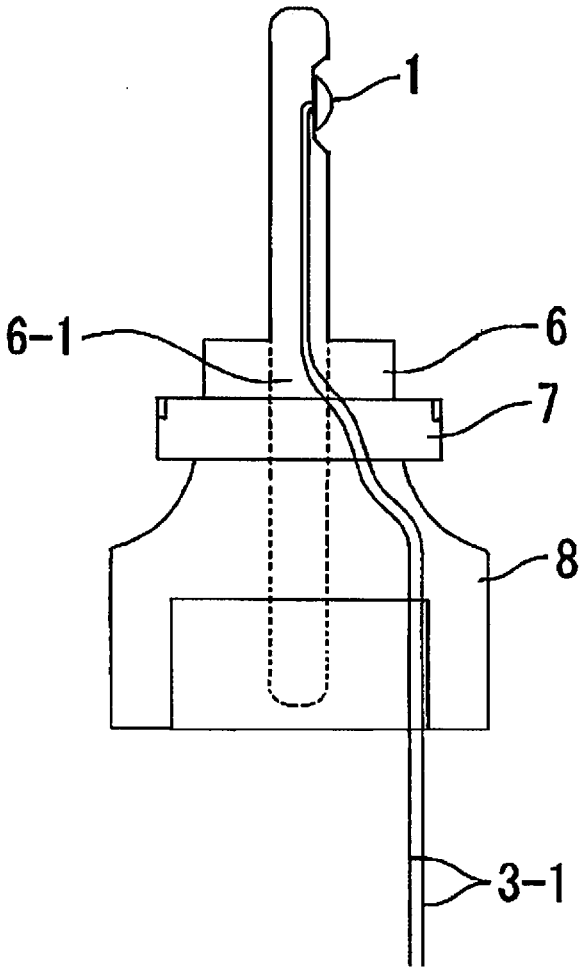
FIG. 1 is a schematic illustration of a head lamp using a light emitting diode.
Figure 2:
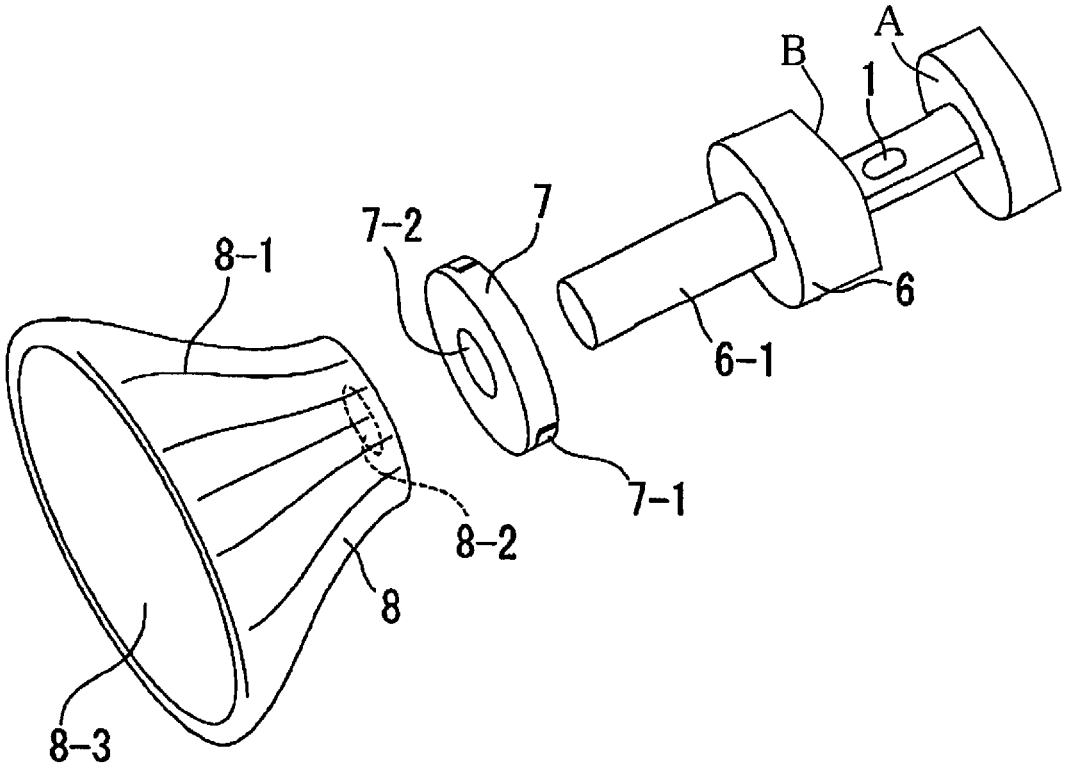
FIG. 2 is an exploded view showing a light source support of a light emitting diode, a mouth piece thereof, and a heat-release mount hereof.

As shown in FIG. 1 to FIG. 2, the light source support 6 is provided with the heat conduction bar 6-1 made of copper, reaching the heat-release mount 8, and the heat conduction bar 6-1 is penetrated through an opening 7-2 bored at the center of the mouth piece 7, and an opening 8-2 bored at the center of the heat-release mount 8, respectively, whereupon the heat conduction bar 6-1 is intimately fitted into the respective openings after the metal paste is applied thereto, thereby releasing heat to the heat-release mount 8 in such a way as to enable direct thermal conduction of the heat generated from the LED.

For the metal paste, use of the gold paste, silver paste, copper paste, nickel paste, and so forth is known, however, the silver paste is preferably used from the viewpoint of the heat dispersion properties thereof, and economics. As the example of the silver paste, CT212M, CT284R, CT285 (produced by KYOCERA Chemicals Corporation), TB3300 series (produced by Three Bond Co. Ltd.), and so forth are cited.

For such fitting, welding by ultrasonic vibration can also be used, and more intimae fitting can be effected in the case where the metal paste is applied to the surface.

The heat-release mount 8 is provided with radiation fins 8-1, and the radiation fins 8-1 each can be in a variety of shapes as desired. Further, the heat-release mount 8 has the hollow part, a radiation fan to be driven by a waterproof motor is provided inside the hollow part, and upon the radiation fan being rotated by the motor, the air is stirred up by the radiation fan, together with the radiation fins, to thereby cause heat-release, so that the light source support 6 is cooled.

Although the power supply line of the LED, and the power supply line of the motor of the radiation fan are not shown, use thereof may be made of any selected from among the electric wire, the electrically conductive film, and the electrically conductive thin sheet, and so forth.

For connection, wire connection via a connector may be adopted, or a type of wire connection carried out at the same time when fixation by a cover is integrally made.

With a cooling structure according to the present invention, illuminance at 1,300 lm can be constantly maintained without causing a decrease in illuminance nearly simultaneously with the lighting of the LED.

The inventor has carried out experimental studies on a high luminance LED at 2,000 lm or higher, and it has been confirmed that the same high illuminance performance as that of the high luminance LED at 1,300 lm can be obtained.

As to a temperature of the LED substrate, 80° C. is the upper limit, and the temperature is ideally held at 80° C. or lower. If the temperature rises to 100° C. or higher, the LED itself will be broken down. Accordingly, designing should be made such that the LED substrate is held at about 80° C. or lower by taking the fins of the radiation fins, the cooling fan, and so forth into consideration.

Since a yellow light emitting diode (LED) is not available, a yellow lamp can be manufactured by covering a glass bulb with a film formed of a yellow pigment although an LED is used for a light source. A yellow coating is easily obtainable by either immersing a glass bulb in a liquid obtained by mixing a yellow organic pigment or a yellow inorganic pigment, nano-dispersed in an organic solvent, with acrylic resin or silicone resin, or spray-coating the glass bulb with a liquid obtained by mixing a yellow pigment with acrylic resin or silicone resin, before drying. The yellow organic pigments include isoindolinon-base yellow organic pigment, isoindolin-base yellow organic pigment, quinophthalone-base yellow organic pigment, ventuimidazolon-base yellow organic pigment, metal complex azo-base yelloworganic pigment, and condensed azo-base yellow organic pigment. Commercial available pigments include Irugajin Yellow L-2040 (manufactured by BASF, isoindolinon-base), Paliotol Yellow L-2140 (manufactured by BASF, isoindolin-base), Paliotol Yellow K-0961HD (manufactured by BASF, quinophthalone-base), and Phosta Pamu Yellow H-3G (manufactured by Clariant Corp, entuimidazolon-base), and so forth.

The yellow inorganic pigments include bismuth vanadate, iron hydroxide, and so forth. Further, an organic solvent solution of an organic vanadium compound as a precursor of bismuth vanadate, and an organic bismuth compound may be mixed with silicone resin obtained by sol-gel reaction, subsequently, a resultant product may be applied to a glass bulb to be baked at a high temperature in a range of 300 to 500° C., and a yellow transparent film may be provided. More specifically, use can be made of 2-ethyl hexanoic acid solution of vanadium (III) acetylacetonate, and 2-ethyl bismuth hexanoate, dissolved in alcohol, such as ethanol, and so forth, being mixed with an alcohol solution of the silicone resin obtained by sol-gel reaction. Furthermore, use can be made of a yellow film obtained by alternately subjecting titanium oxide and silicon oxide to vacuum deposition relative to the glass bulb.

Embodiment 1

A first embodiment of the invention is described with reference to FIG. 5.

Figure 9:
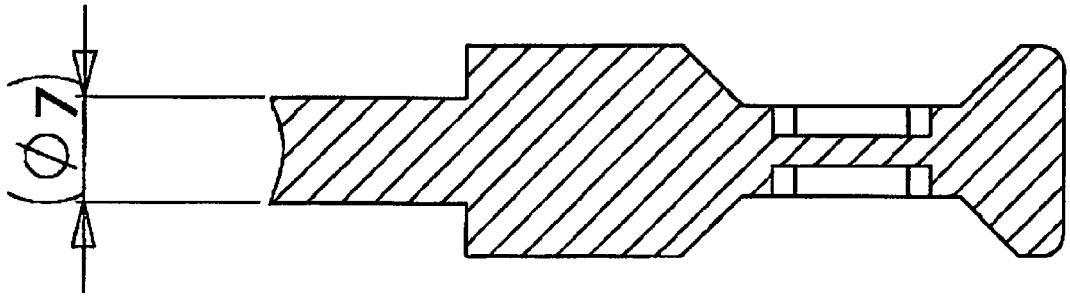
FIG. 9 is a view showing an example of a light source support of the head lamp using the LED, according to the invention.

In FIG. 5, a light source support 6 has a copper core 7 mm in outside diameter, and 70 mm in length. For the copper core, use is made of 99.6% purity copper (refer to FIG. 9). An aluminum thin sheet fixed to the back side of a semiconductor substrate with a light emitting diode (an LED) mounted thereon is bonded to the surface of the light source support 6 with the use of a heat-conductive adhesive (SK60N, produced by Diemat Inc.).

Embodiment 2

Figure 7:
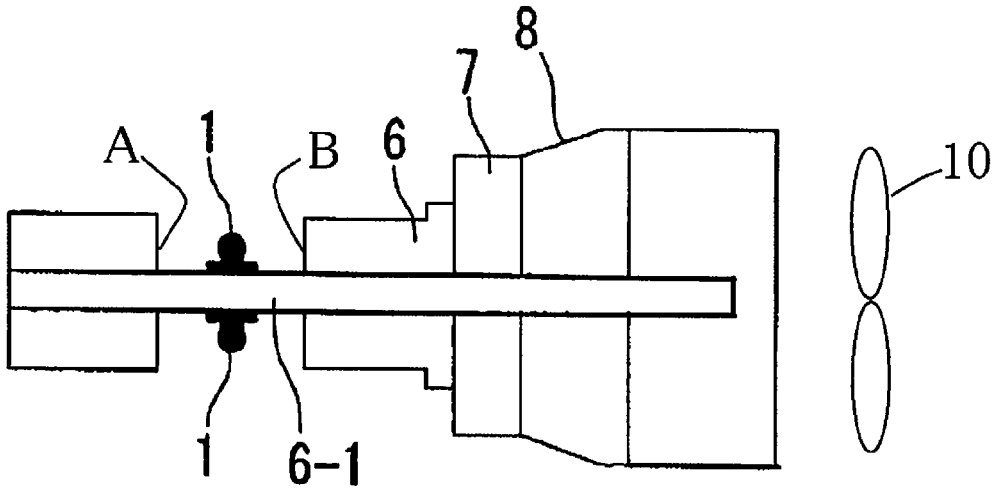
FIG. 7 is a schematic illustration showing still another example of the head lamp using the LED (provided with a fan), according to the invention.
Figure 8:
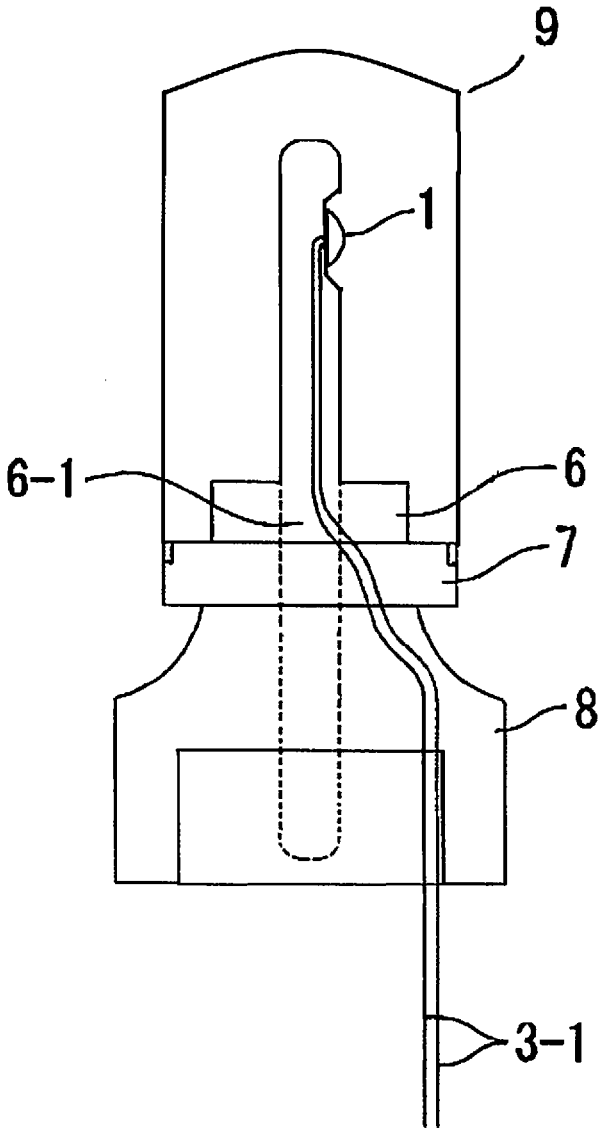
FIG. 8 is a schematic illustration showing a further example of the head lamp using the LED (yellow LED), according to the invention.

A second embodiment of the invention is described with reference to FIG. 7. In FIG. 7, an aluminum thin sheet fixed to the back side of a semiconductor substrate with a light emitting diode (LED) mounted thereon is bonded to the surface of the light source support 6 by welding using ultrasonic vibration.

Embodiment 3

Figure 6:
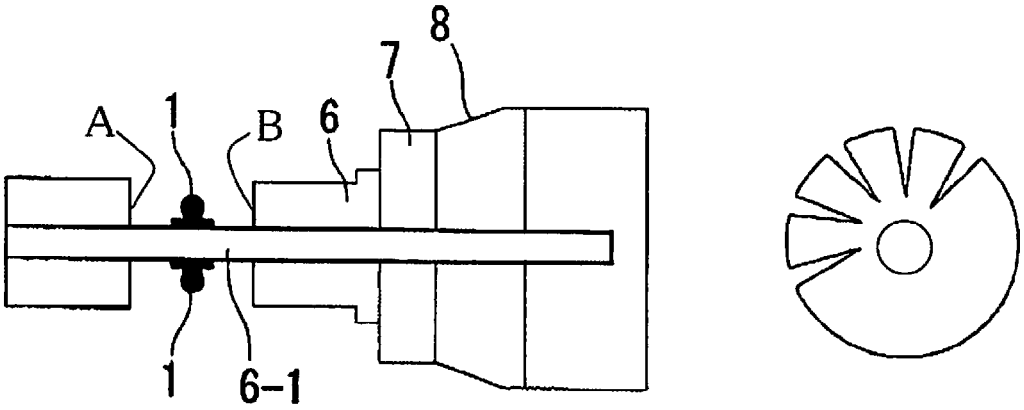
FIG. 6 is a schematic illustration showing another example of the head lamp using the LED, according to the invention.

A third embodiment of the invention is described with reference to FIG. 6. In FIG. 6, an aluminum thin sheet fixed to the back side of a semiconductor substrate with a light emitting diode (LED) mounted thereon is bonded to the surface of the light source support 6 by welding using ultrasonic vibration. Further, a fan to be driven by a waterproof motor is installed inside the hollow part, as shown in FIG. 7. Brightness at the time when the fan was rotated was found the same as that in the second embodiment, and brightness at the time when the fan was stopped was found as follows Table 1 shows the characteristics of a vehicle head lamp using the LED, according to the invention.

TABLE 1

| | Emb. 1 | Emb. 2 | Emb. 3 | Comp. 1 | Comp. 2 |
|---|---|---|---|---|---|
| Cu—Al structure | available | available | available | none | none |
| substrate fixing | adhesive | ultrasonic welding | ultrasonic welding | ultrasonic welding | adhesive |
| fan driving | available | available | stopped | available | none |
| brightness (lighting) | 1,500 | 1,500 | 1,500 | 1,500 | 1,500 |
| lumen brightness (30 min after lighting) | 1,330 | 1,420 | 1,400 | 1,280 | 1,200 |
| lumen brightness (60 min after lighting) | 1,310 | 1,400 | 1,380 | 1,230 | 950 |
| lumen brightness (120 min after lighting) | 1,300 | 1,400 | 1,380 | 1,200 | 920 |
| lumen | | | | | |

Remarks:

By "none" in Cu—Al structure in Table 1, is meant a configuration where all the copper part of the light source support is replaced with aluminum.

Embodiment 4

(Example of Manufacturing Yellow Lamp)

A liquid was obtained by dissolving 4.0 g of 2-ethyl hexanoic acid solution (Bi: 25%) of 1.3 g of vanadium (III) acetylacetonate (98%), as the precursor of bismuth vanadate, and 2-ethyl bismuth hexanoate (III), into 40 g of ethanol, to be mixed with 0.65 g of alcohol solution (non-volatile matter 20%) of silicone resin obtained by sol-gel reaction, and the liquid was spray-applied to a glass bulb (in the shape of a cylinder 15 mm in outside diameter, 45 mm in length) to abut 1 μm in film thickness to be dried at room temperature for 10 min before baking at 450° C. for 30 min, whereupon a transparent glass bulb colored in lemon yellow was obtained. This bulb was placed on the external side of the illuminating lamp using the LED, and upon lighting after wire connection, the bulb produced a yellow color.

Embodiment 5

(Vehicle Head Lamp, Using an LED)

For individual vehicle head lamps, a predetermined standard applies, and a vehicle head lamp, using the light emitting diode (the LED), can be manufactured according to the same standard as applied to a current type halogen lamp, and high density discharge lamp, respectively. Since the LED can produce colors other than the yellow color, the vehicle head lamp, using the LED, does not particularly require the glass bulb.

Table 2 shows JIS

TABLE 2

| | | |
|---|---|---|
| H4 12 V | Lo | 31.25 |
| H4 12 V | Hi | 24.55 |
| H4 24 V | Lo | 31.625 |
| H4 24 V | Hi | 27.375 |
| H11 | | 27.25 |
| H9 | | 27.4 |
| H8 | | 26.85 |
| H1 | | 27.5 |
| H7 | | 27.05 |
| HB3 | | 31.5 |
| HB4 | | 31.5 |
| H3 · C · D | | 18 |
| HS1 | | 31.25 |
| H16 | unavailable in | JIS |
| D2 · D4 | | 27.1 |

Numerical value in Table 2 indicates a length (mm) from a reference face of the mouth piece to the center of an LED luminous element.

Industrial Applicability

The illuminating lamp and the vehicle head lamp, using the LED, respectively, according to the invention, are suited for illumination in all the industrial fields, and have, therefore, high industrial applicability because of a wide range of application.

What is claimed is:

1. An illuminating lamp using a light emitting diode, the illuminating lamp including:

a light source support made up of an upper structure where an aluminum sheet fixed to a semiconductor substrate with a light emitting diode mounted thereon is directly fixed to a region of the surface of a heat conduction bar made of copper, with other than the region thereof with the aluminum sheet fixed thereto being coated with aluminum up to a mouth piece in such a way as to form light-shielding walls, and a lower structure having a long heat conduction bar made of copper, the upper structure being linked with the lower structure via the heat conduction bar made of copper, wherein the light source support is inserted into an aluminum heat-release mount, a central part thereof being hollow, through a mouth piece, via the heat conduction bar made of copper, to be secured at a position where the tip of the heat conduction bar made of copper reaches a point deep inside the hollow part of the aluminum heat-release mount, thereby causing heat generated from the light emitting diode to be released into the aluminum heat-release mount through cooling of the heat conduction bar made of copper by the air inside the hollow part.

2. The illuminating lamp using the light emitting diode according to claim 1, wherein the aluminum sheet fixed to the semiconductor substrate with the light emitting diode mounted thereon is directly fixed to the heat conduction bar made of copper by ultrasonic welding.

3. The illuminating lamp using the light emitting diode according to claim 1, wherein the long heat conduction bar made of copper, as the lower structure of the light source support, is inserted into the aluminum heat-release mount, the central part thereof being hollow, through a mouth piece, to be secured at the position where the tip of the heat conduction bar made of copper reaches the point deep inside the hollow part of the aluminum heat-release mount, and molten aluminum is poured into the hollow part, on a side thereof, adjacent to the mouth piece, thereby securing a part of the heat conduction bar, on a side thereof, adjacent to the mouth piece.

4. The illuminating lamp using a light emitting diode according to claim 1, wherein a radiation groove or a radiation fin is provided on the surface of the aluminum of the upper structure of the light source support, and the hollow part of the heat-release mount, the central part thereof being hollow, is provided with the radiation fin on the outer periphery thereof, the hollow part being formed in the shape of a column or a prism.

5. The illuminating lamp using the light emitting diode according to claim 1, wherein the hollow part of the heat-release mount is formed in the shape of a column or prism, and a radiation fan driven by a waterproof motor is provided inside the hollow part.

6. A vehicle head lamp comprising the illuminating lamp using light emitting diode according to claim 1, wherein a projection lens and the center axis of a light source support are disposed on an optical axis extending in the front to back direction of a vehicle, a light emitting diode serving as a light source is fixed to an upper face or a lower face of a light source support, in relation to the optical axis, and a reflecting mirror is provided on the optical axis such that light emanated from the light source is substantially projected through the projection lens in the direction of the optical axis.

7. The vehicle head lamp according to claim 6, wherein the light emitting diode has a luminous flux at 1,300 lm or more.

8. The vehicle head lamp according to claim 6, wherein a distance from the center of the light source to a reference face of the mouth piece is selected from the group consisting of 31.25 mm, 24.55 mm, 31.625 mm, 27.375 mm, 27.25 mm, 27.4 mm, 26.85 mm, 27.5 mm, 27.05 mm, 31.5 mm, 18 mm, 31.25 mm, and 27.1 mm.

9. The illuminating lamp according to claim 1, wherein a yellow transparent glass bulb is fixed to the outside of the illuminating lamp.

* * * * *